US010850141B2

(12) United States Patent
Andrews

(10) Patent No.: US 10,850,141 B2
(45) Date of Patent: Dec. 1, 2020

(54) MASK WITH SELF-ADHERENT SECUREMENT STRAP AND METHODS THEREFOR

(71) Applicant: Medline Industries, Inc, Northfield, IL (US)

(72) Inventor: Melanie Andrews, Lake Villa, IL (US)

(73) Assignee: Medline Industries, Inc., Northfield, IL (US)

( * ) Notice: Subject to any disclaimer, the term of this patent is extended or adjusted under 35 U.S.C. 154(b) by 553 days.

(21) Appl. No.: 15/593,190

(22) Filed: May 11, 2017

(65) Prior Publication Data

US 2018/0326232 A1 Nov. 15, 2018

(51) Int. Cl.

| | |
|---|---|
| ***A62B 18/02*** | (2006.01) |
| ***A62B 23/02*** | (2006.01) |
| ***A62B 18/08*** | (2006.01) |

(52) U.S. Cl.

CPC ..... *A62B 23/025* (2013.01); *A62B 18/084* (2013.01)

(58) Field of Classification Search

CPC ..... A41D 13/11–1176; A62B 18/025; A62B 18/084; A62B 23/025; A61M 16/0683; A61M 16/0688

See application file for complete search history.

(56) References Cited

U.S. PATENT DOCUMENTS

| | | | | |
|---|---|---|---|---|
| 1,775,718 A | | 9/1930 | Garvey | |
| 3,333,585 A | | 8/1967 | Barghini | |
| D210,181 S | | 2/1968 | Solomon | |
| 3,603,315 A | | 9/1971 | Becker, III | |
| 3,884,227 A | | 5/1975 | Lutz et al. | |
| 4,419,993 A | | 12/1983 | Petersen | |
| 4,635,628 A | | 1/1987 | Hubbard et al. | |
| 4,802,473 A | * | 2/1989 | Hubbard | A41D 13/1115 128/206.13 |
| 4,867,148 A | | 9/1989 | Gomez | |
| 4,920,960 A | | 5/1990 | Hubbard et al. | |
| 4,941,470 A | | 7/1990 | Hubbard | |
| 4,969,457 A | | 11/1990 | Hubbard et al. | |
| 5,307,796 A | | 5/1994 | Kronzer et al. | |
| 5,553,608 A | | 9/1996 | Reese et al. | |
| D377,241 S | | 1/1997 | Kenner | |
| 5,636,628 A | | 6/1997 | Barnum | |
| D383,537 S | | 9/1997 | Lunden | |

(Continued)

FOREIGN PATENT DOCUMENTS

WO WO2016028553 * 2/2016

OTHER PUBLICATIONS

Oswecki, Elizabeth, "Notice of Allowance", U.S. Appl. No. 29/670,908, filed Nov. 20, 2018; dated Dec. 26, 2018.

(Continued)

*Primary Examiner* — Bradley H Philips

(74) *Attorney, Agent, or Firm* — Philip H. Burrus, IV

(57) ABSTRACT

A mask (100) includes a mask panel (101) configured to cover a portion (1201) of the face (1202) of a wearer and a securement strap (102) configured to retain the mask panel against the portion of the face. The securement strap can be manufactured from a self-adherent material (603). The securement strap can be adjusted by compressing a first portion (701) of the self-adherent material against a second portion (702) of the self-adherent material, thereby causing the first portion to couple to the second portion.

20 Claims, 8 Drawing Sheets

(56) References Cited

U.S. PATENT DOCUMENTS 5,706,804 A 1/1998 Baumann et al.
5,803,075 A 9/1998 Yavitz
5,813,398 A 9/1998 Baird et al.
D400,674 S 11/1998 Miura
5,842,470 A 12/1998 Ruben
5,891,508 A 4/1999 Barnum
5,927,280 A 7/1999 Miyake
5,939,339 A * 8/1999 Delmore ..... A61F 13/0273 428/354
D420,769 S 2/2000 White
6,062,220 A 5/2000 Whitaker et al.
6,394,090 B1 5/2002 Chen et al.
D493,920 S 8/2004 Hillman
D511,209 S 11/2005 Callan
7,004,167 B2 2/2006 Cheng
D520,189 S 5/2006 Hillman
7,044,127 B1 5/2006 Fernandez DeCastro
D530,418 S 10/2006 Henry
D533,686 S 12/2006 Hillman
D536,834 S 2/2007 Hillman
D537,210 S 2/2007 Hillman
D537,572 S 2/2007 Hillman
D539,484 S 3/2007 Hillman
7,290,545 B2 11/2007 Kleman et al.
D636,537 S 4/2011 Ladua
D638,171 S 5/2011 Goranov et al.
D640,011 S 6/2011 Teng
8,066,006 B2 11/2011 Daugaard et al.
D654,250 S 2/2012 Kaufman
8,171,933 B2 5/2012 Xue et al.
8,342,180 B2 1/2013 Martin et al.
D681,881 S 5/2013 Pong
D693,062 S 11/2013 Bowen et al.
D737,002 S 8/2015 Olson
9,386,813 B2 7/2016 Nagao et al.
D777,988 S 1/2017 Miros
D782,029 S 3/2017 Kuhn
9,655,392 B2 5/2017 Mekler et al.
9,770,058 B2 9/2017 Angadjivand et al.
D803,391 S 11/2017 Reese et al.
9,868,002 B2 1/2018 Duffy
D822,195 S 7/2018 Kwong et al.
2002/0052570 A1 5/2002 Naimer
2003/0176828 A1* 9/2003 Buckman ..... A61F 13/00063 602/48
2004/0078869 A1* 4/2004 Bell ..... A41D 13/1161 2/206
2004/0118405 A1* 6/2004 Amante ..... A41D 13/1161 128/206.19
2004/0173216 A1 9/2004 Park
2005/0058816 A1 3/2005 Gorres
2005/0098182 A1* 5/2005 Callan ..... A41D 13/11 128/206.19
2007/0106354 A1* 5/2007 Carstens ..... A41D 13/1161 607/112
2008/0295843 A1 12/2008 Haas
2009/0205666 A1 8/2009 Bowen
2009/0320848 A1* 12/2009 Steindorf ..... A41D 13/1138 128/206.21
2009/0320849 A1 12/2009 Biedermann
2010/0218774 A1 9/2010 Flaherty
2011/0180078 A1* 7/2011 McKinley ..... A41D 13/1161 128/863
2011/0308525 A1 12/2011 Lu et al.
2012/0272973 A1 11/2012 Palomo et al.
2014/0076334 A1 3/2014 Cheng et al.
2014/0182600 A1 7/2014 Duffy
2014/0224261 A1 8/2014 Tsuei
2014/0237695 A1 8/2014 Al Malki
2014/0251335 A1* 9/2014 Black ..... A61M 16/0616 128/205.25
2014/0326255 A1 11/2014 Teng
2015/0001308 A1* 1/2015 Meier ..... A01N 25/18 239/6
2015/0056102 A1 2/2015 Yamada et al.
2015/0216241 A1 8/2015 Lee et al.
2016/0015098 A1 1/2016 Conlon
2016/0029715 A1 2/2016 Zheng et al.
2016/0029716 A1 2/2016 Duncan et al.
2016/0151650 A1 6/2016 Reese
2016/0235136 A1 8/2016 Palomo et al.
2016/0310327 A1 10/2016 Rule et al.
2017/0079868 A1 3/2017 Reid, Jr. et al.
2017/0274228 A1* 9/2017 Nguyen ..... A61F 11/14

OTHER PUBLICATIONS

"3M Health Care", 3M Coban Sterile Self Adherent Wraps and 3M Coban LF Latex Free Sterile Self-Adherent Wraps; Product Information; Copyright 2010; Unknown Publication Date but believed to be prior to filing of present application.

Braswell, Melanie et al., "Implementing Aorn Recommended Practices for Surgical Attired", AORN Journal, Jan. 2012; Published in AORN's Perioperative Standards and Recommended Practices in Nov. 2010.

Ingris-Arkell, Esther , "How does cling wrap cling?", Gizmodo Article; View Apr. 20, 2017; Originally posted Jun. 3, 2011; http://gizmodo.com/5807661/how-does-cling-wrap-cling.

Spruce, Lisa et al., "Guideline for Surgical Attire", Guidelines for Perioperative Fraction, 2015 edition; Aseptic Practice; Originally Published Mar. 1975 in AORN Journal.

Oswecki, Elizabth , "Notice of Allowance", U.S. Appl. No. 29/603,744, filed May 11, 2017; dated Aug. 14, 2018.

* cited by examiner

MASK WITH SELF-ADHERENT SECUREMENT STRAP AND METHODS THEREFOR

BACKGROUND

Technical Field

This disclosure relates generally to masks, and more particularly to masks with securement straps.

Background Art

Many types of people wear masks to avoid the inhalation of airborne objects. Additionally, some people wear masks to avoid the spread of germs or pathogens. Illustrating by example, many medical professionals wear masks to ensure that any microbial organisms residing in their oral or nasal passages are not spread to a patient. Similarly, an allergy sufferer may wear a mask to avoid the inhalation of pollen.

Regardless of why a mask is worn, its efficacy depends upon the mask fitting the wearer properly. Where a mask is ill fitting, air can pass about the perimeter of the mask. This can allow pathogens from the wearer to escape the confines of the mask, or alternatively can let airborne objects pass about the mask to the wearer. It would be advantageous to have an improved mask that provides a better fit.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
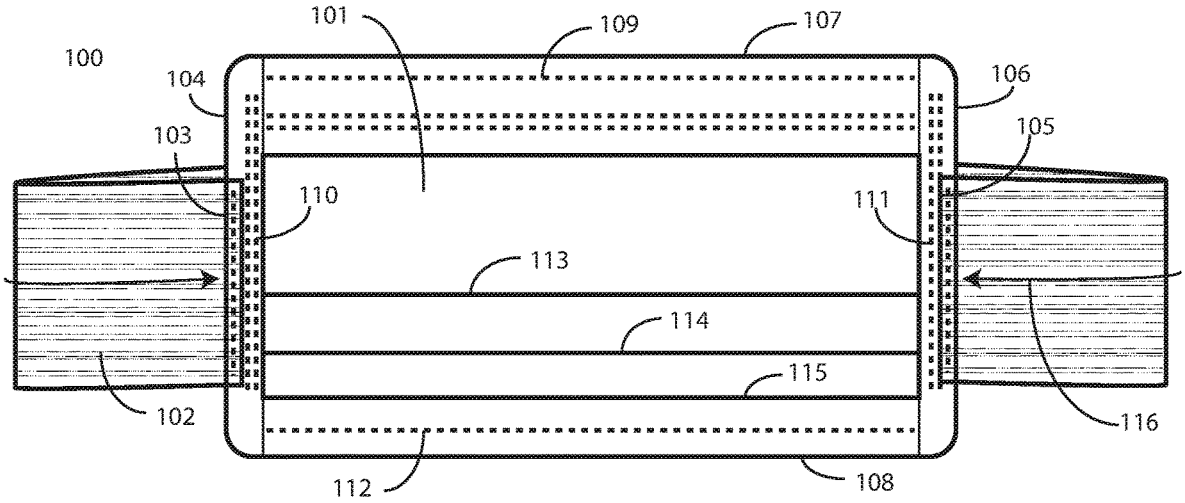
FIG. 1 illustrates one explanatory mask in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. As used herein, components may be "operatively coupled" when information can be sent between such components, even though there may be one or more intermediate or intervening components between, or along the connection path. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

As noted above, the performance and efficacy of a mask is dependent upon the mask fitting the wearer properly. Where a mask is ill fitting, air can pass about the perimeter of the mask, which can be problematic. For example, in a surgical setting, a surgeon wears a mask to prevent contamination of the sterile surgical field from nasopharyngeal and/or respiratory microorganisms that may be exhaled with the surgeon's breath. If a mask does not fit properly, the surgical field can become contaminated.

Many prior art surgical masks include a mask body that is flanked by two thin, stringy, elastic "ear loops." To don the mask, the user places the mask over their nose and mouth. The user then loops one of the stringy loops about one ear, and the other stringy loop about the other ear.

Embodiments of the disclosure contemplate that these masks perform sub-optimally. This is especially true in a medical setting. Embodiments of the disclosure contemplate that prior art masks that include stringy, elastic ear loops frequently do not provide a secure facial fit. Accordingly, such masks frequently fail to prevent venting along the sides of the mask. Due to this deficiency, masks with stringy, elastic ear loops do not effectively cover the mouth and nose. As such, medical professionals using such masks run the risk of transmitting nasopharyngeal and respiratory microorganisms to a patient or a sterile field. At the same time, medical professionals enjoy the ease with which the stringy, elastic ear loop masks can be donned. This is true because there are no strings to tie behind their head.

Advantageously, embodiments of the disclosure provide a mask that provides the proper fit and coverage of the nose and mouth, that retains the ease of donning without using stringy, elastic ear loops. In one or more embodiments, a mask includes a mask panel and a securement strap. A first end of the securement strap is coupled to a first side of the mask panel, while a second end of the securement strap is coupled to a second side of the mask panel. While multiple securement straps can be used, in one or more embodiments the securement strap comprises a single securement strap.

To make the mask easily adjustable, in one or more embodiments the securement strap is manufactured from a self-adherent material that is capable of sticking to itself. In one or more embodiments the self-adherent material is porous and elastomeric to increase comfort. Examples of self-adherent materials include electrostatically self-adherent materials and physically self-adherent materials. Examples of physically self-adherent materials comprise materials with hook and loop fasteners, materials with a "low-tack" adhesive disposed thereon, and materials manufactured from components that have a self-adhering affinity.

In one or more embodiments, a length of the securement strap is adjustable by compressing portions of the securement strap together. This compression causes the self-adherent material to adhere to itself. Accordingly, a user can pinch portions of the securement strap together to shorten the length. The user can then pull those same portions apart to increase the length of the securement strap.

Embodiments of the disclosure contemplate that masks employing securement straps as described below secure the mask against a user's face by passing about the back of the head rather than behind the ears. Advantageously, this back of the head securement system, which is adjustable due to the self-adhering nature of the material from which the securement strap is manufactured, reduce the risk of transmitting nasopharyngeal and respiratory microorganisms to a patient to a sterile field. Moreover, due to the stretchy nature of the securement straps in many embodiments, donning masks configured in accordance with one or more embodiments of the disclosure is quick and simple. Advantageously, embodiments of the disclosure provide a securement strap that allows for a secure and adjustable fit. Since the mask is so simple to don, a user will be less inclined to simply let the mask hang about their neck, which can compromise the sterility of the outer surfaces of the mask.

Turning now to FIG. 1, illustrated therein is one explanatory mask 100 configured in accordance with one or more embodiments of the disclosure. In this illustrative embodiment, the mask 100 includes a mask panel 101 and a securement strap 102. A first end 103 of the securement strap 102 is coupled to a first side 104 of the mask panel 101. A second end 105 of the securement strap 102 is coupled to a second side 106 of the mask panel 101.

The first end 103 and the second end 105 of the securement strap 102 can be coupled to the first side 104 and the second side 106 of the mask panel 101, respectively, in any of a variety of ways. For example, in one embodiment the first end 103 and the second end 105 of the securement strap 102 can be coupled to the first side 104 and the second side 106 of the mask panel 101 by stitching. In another embodiment, first end 103 and the second end 105 of the securement strap 102 can be adhesively coupled to the first side 104 and the second side 106 of the mask panel 101. In another embodiment, first end 103 and the second end 105 of the securement strap 102 can be coupled to the first side 104 and the second side 106 of the mask panel 101 by thermal bonding. In still another embodiment, first end 103 and the second end 105 of the securement strap 102 can be coupled to the first side 104 and the second side 106 of the mask panel 101 with a metal fastener. Other ways of coupling the first end 103 and the second end 105 of the securement strap 102 can be coupled to the first side 104 and the second side 106 of the mask panel 101 will be obvious to those of ordinary skill in the art having the benefit of this disclosure.

In one or more embodiments, the mask panel 101 is configured to cover a portion of the face of a wearer. In one embodiment, the mask panel 101 is configured to at least cover the mouth and nose of a wearer. In one or more embodiments, the securement strap 102 is configured to retain the mask panel 101 against the portion of the face by passing about the back of the head of the wearer.

Figure 13:
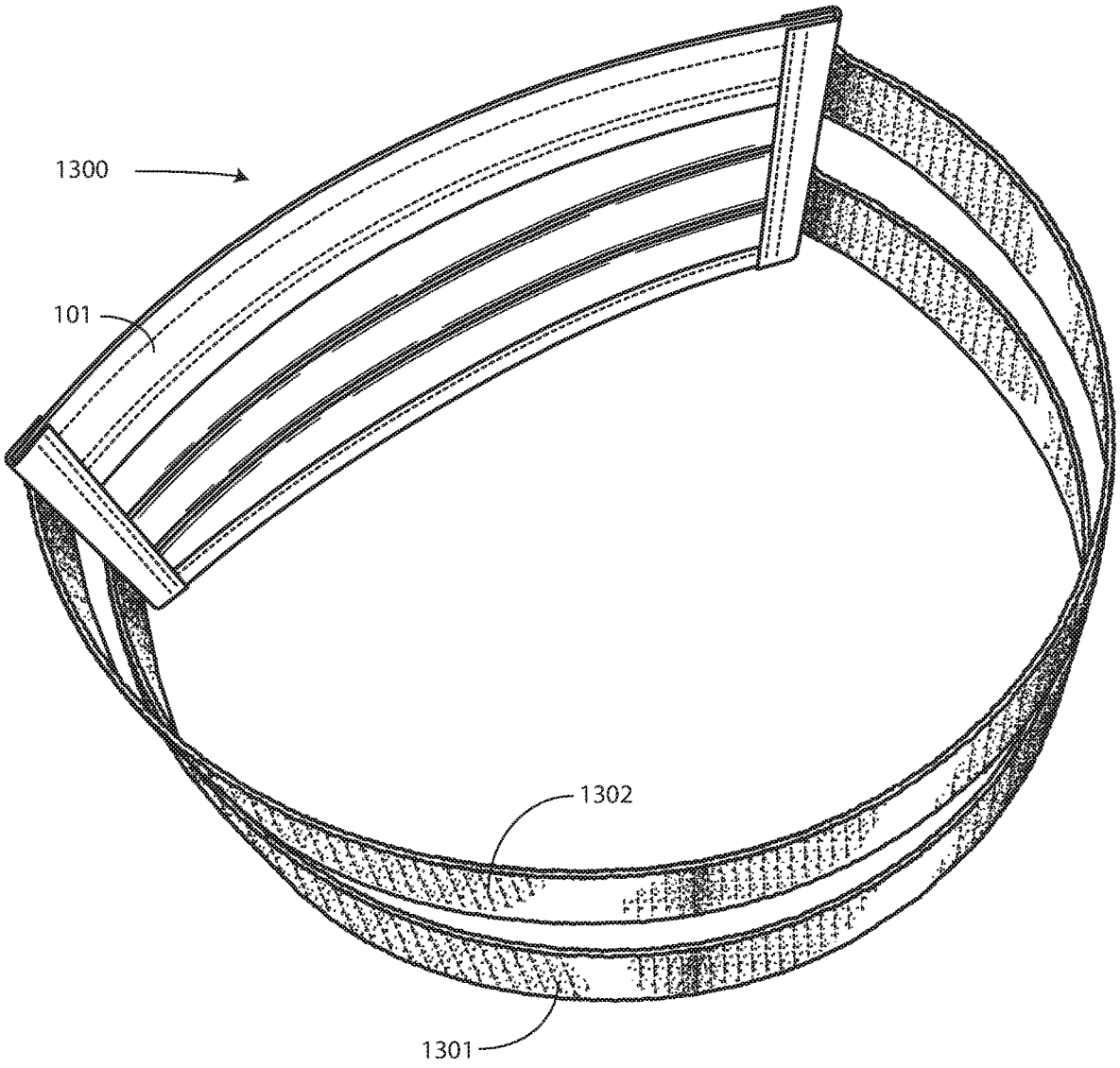
FIG. 13 illustrates another explanatory mask in accordance with one or more embodiments of the disclosure.

In the illustrative embodiment of FIG. 1, a single securement strap 102 is coupled to the mask panel 101. However, embodiments of the disclosure are not so limited. In other embodiments, two securement straps 102 can be attached to the mask panel 101. Such an embodiment 1300 is shown in FIG. 13, where a first strap 1301 and a second strap 1302 are coupled to the mask panel 101. In still other embodiments, three or more securement straps can be attached to the mask panel 101. In each of these embodiments, regardless of the number of securement straps used, each securement strap is configured to retain the mask panel 101 against the portion of the face by passing about the back of the head of the wearer.

Turning now back to FIG. 1, in one embodiment, the mask panel 101 is rectangular in shape. In one or more embodiments, the mask panel is manufactured from one or more layers of soft paper or textile material that are joined together at a top edge 107, a bottom edge 108, and along the first side 104 and the second side 106 of the mask panel 101, respectively. In addition to paper or textile material, other air permeable, filtering materials could be used as well. Illustrating by example, in one embodiment composite materials joined by pressure, heat, or other techniques can be used.

In one or more embodiments, the mask panel 101 is constructed from synthetic materials so that the layers can be sealed with a heat-sealing technique. Heat-sealing advantageously eliminates the appearance of loose fibers by bonding them to the mask panel 101 where present. Moisture barriers can be incorporated into the mask panel 101. Chemical treatments such as antimicrobial or antifungal coatings can be applied to the mask panel 101 as well. Bendable metal stays can be included to more readily cause the mask panel 101 to conform to contours of a wearer's face.

The layers of material can be joined at the top edge 107, bottom edge 108, first side 104, and second side 106 of the mask panel 101 using thermal bonding, adhesives, stitching, sonic welding, or other coupling techniques. One or more sealing lines 109,110,111,112 are shown in FIG. 1 where the various layers are joined together. In one or more embodiments, the top edge 107 and the bottom edge 108 are continuously formed by folding a portion of the mask material over, and under, the top edge 107 and bottom edge 108, respectively. Where this is done, it helps to keep the layers of filter material together. In one or more embodiments, the layers of material defining the mask panel 101 can be folded about the bottom edge 108.

In one or more embodiments, the central portion of the mask panel 101 is folded so as to have one or more pleats 113,114,115. In one or more embodiments, each pleat 113, 114,115 defines an expandable fold that, when expanded, extend a major dimension of the mask panel 101.

For example, when applied to a user's face, the top edge 107 can be pulled from the bottom edge 108 to expand the pleats so that the mask panel 101 covers a portion of the wearer's face extending from at least the bridge of the nose to beneath the chin. In one or more embodiments, the width of the mask panel 101 is sufficiently wide so that the mask panel 101 covers at least a portion of the wearer's cheeks as well. The first side 104 and second side 106 function as stabilizers for the expansion of the one or more pleats 113,114,115 when the mask is donned.

In one or more embodiments, the mask panel 101 is soft and pliable so as to be readily able to conform to the contours of a wearer's face. When the one or more pleats 113,114,115 expand, in one or more embodiments the top edge 107, bottom edge 108, first side 104, and second side 106 remain against the face of the wearer to provide mechanical seal. This mechanical seal forces respiratory air from the wearer to pass through the mask panel 101, thereby preventing germs from passing round the sides of the mask panel 101.

In one or more embodiments, the securement strap 102 is designed to be adjustable so that the mask 100 more readily fits a wide range of wearer's heads. In one or more embodiments, the length 116 of the securement strap 102 can be adjusted by "pinching" together portions of the securement strap to shorten the length 116. This very simple, quick, and easy adjustment technique is possible, in one or more embodiments, due to the fact that the securement strap 102 is manufactured from a self-adherent material.

As will be described below with reference to FIGS. 2-5, the self-adherent material used for the securement strap 102 can take various forms. It can include electrostatically self-adherent materials or mechanically self-adherent materials. Regardless of technology, in one or more embodiments the self-adherent wrap cohesively couples to itself when pressure is applied. The components responsible for the self-adherence retain portions of the self-adherent wrap coupled together with a bonding force that resists relatively high shearing stresses. At the same time, in one or more embodiments the self-adherent wrap will not adhere to the skin of a wearer, their hair, or their clothing.

Figure 2:
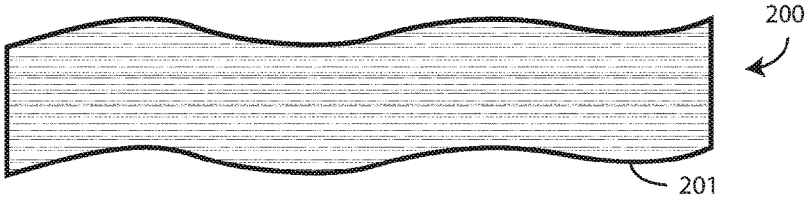
FIG. 2 illustrates one explanatory securement strap in accordance with one or more embodiments of the disclosure.

Turning now to FIG. 2, illustrated therein is one example of a self-adherent wrap 200. The self-adherent wrap 200 of FIG. 2 is a physically self-adherent material that includes a substrate 201 that is both porous and elastomeric. Advantageously, the substrate 201 can readily conform to the contours of a wearer's head or neck to retain a mask using the self-adherent wrap 200 as a securement strap to their face.

In one or more embodiments, the self-adherent wrap 200 of FIG. 2 comprises Coban.sup.™ material manufactured by the 3M of Minnesota. However, other physically self-adherent materials can be substituted for the Coban.sup.™. Illustrating by example, Self-Grip.sup.™ bandage, manufactured by Conoco Medical Company of Connecticut, or Co-Flex-.sup.™, manufactured by Andover Coating Products of Mississippi can be substituted for the Coban.sup.™ wrap in other embodiments. Examples of these self-adherent wraps are described in U.S. Pat. No. 5,939,339 to Delmore et al. and U.S. Pat. No. 3,575,782 to Hansen, each of which is incorporated herein by reference.

Figure 3:
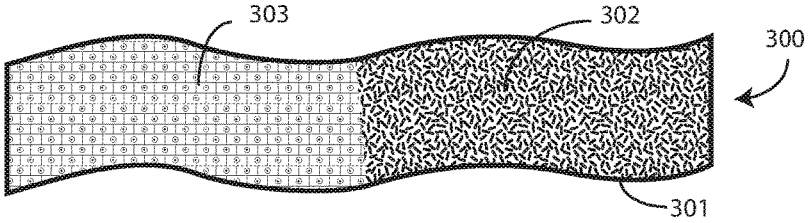
FIG. 3 illustrates another explanatory securement strap in accordance with one or more embodiments of the disclosure.

Turning now to FIG. 3, illustrated therein is another self-adherent wrap 300. The self-adherent wrap 300 of FIG. 3 is another physically self-adherent material. In this illustrative embodiment, the self-adherent wrap 300 comprises a substrate 301 having hook fasteners 302 and loop fasteners 303 disposed therealong. The hook fasteners 302 and loop fasteners 303 cause the self-adherent wrap 300 to be "self-adherent" because pressing hook fasteners 302 against loop fasteners 303 causes one portion of the substrate 301 to physically adhere to another portion of the substrate 301. Similarly, these portions can be separated by pulling them apart.

Figure 4:
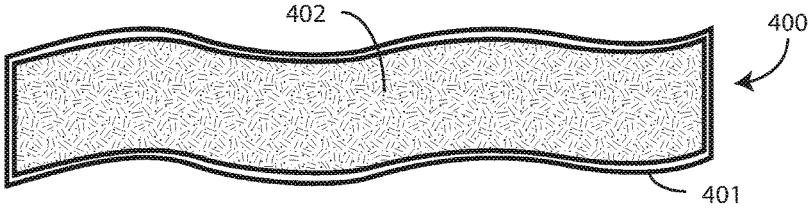
FIG. 4 illustrates another explanatory securement strap in accordance with one or more embodiments of the disclosure.

Turning now to FIG. 4, illustrated therein is another self-adherent wrap 400. This self-adherent wrap 400 also uses a physical self-adhering mechanism. In this embodiment, the self-adherent wrap 400 comprises a substrate 401 having a low-tack adhesive 402 disposed thereon. Examples of low-tack adhesives 402 include thermoplastic elastomers configured as a pressure sensitive adhesive having a release coefficient below a predetermined threshold. For example, certain styrenic block polymers do well at holding components together, while at the same time being characterized by low tack levels or a reduced tendency to adhere to unlike materials. The "tack" of an adhesive defines the ability of the adhesive to form a bond with another layer of the adhesive in response to the application of pressure pressing the layers of adhesive together.

Figure 5:
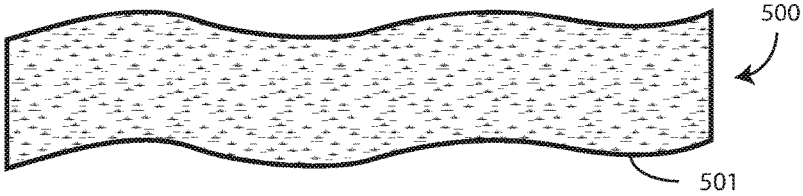
FIG. 5 illustrates yet another explanatory securement strap in accordance with one or more embodiments of the disclosure.

Turning now to FIG. 5, illustrated therein is yet another self-adherent wrap 500. As before, the self-adherent wrap 500 comprises a substrate 501. In this illustrative embodiment, rather than being physically self-adherent, the substrate is electrostatically self-adherent. In this illustrative embodiment, molecules defining the substrate 501 can carry an electrostatic charge so as to be able to "stick" to other molecules of the substrate 501. Illustrating by example, the substrate 501 can be manufactured from a material such as polyvinyl chloride, low-density polyethylene, or another similar material. In one or more embodiments, the material includes chains of long polymers that electrostatically adhere to other polymers.

It should be noted that the self-adherent wraps 200,300, 400,500 of FIGS. 2-5 are merely examples of various types of self-adherent wraps that can be used in accordance with embodiments of the disclosure. Moreover, each of the self-adherent wraps 200,300,400,500 of FIGS. 2-5 can be manufactured in different ways. For example, in one embodiment each of the self-adherent wraps 200,300,400,500 of FIGS. 2-5 are porous. In another embodiment, each of the self-adherent wraps 200,300,400,500 of FIGS. 2-5 are elastomeric and capable of stretching. Of course, the self-adherent wraps 200,300,400,500 of FIGS. 2-5 can be both porous and elastomeric. Additionally, a variety of different colors and patterns can be applied to the self-adherent wraps 200,300, 400,500 of FIGS. 2-5. Printing can be applied to the self-adherent wraps 200,300,400,500 of FIGS. 2-5 to explain to a user how to adjust a mask using the self-adherent wraps 200,300,400,500 of FIGS. 2-5 as securement straps. Other self-adherent wraps, and configurations thereof, will be obvious to those of ordinary skill in the art having the benefit of this disclosure.

Figure 6:
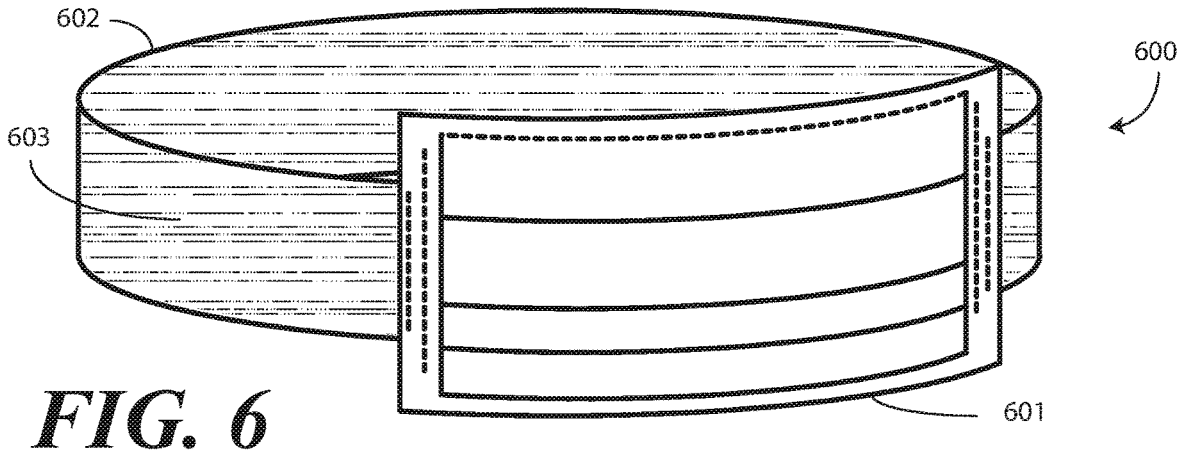
FIGS. 6-11 illustrate one or more explanatory steps for adjusting a length of a securement strap in accordance with one or more embodiments of the disclosure.

Turning now to FIG. 6, illustrated therein is one explanatory mask 600 that includes a mask panel 601 and a securement strap 602. The mask panel 601 is configured to cover a portion of a face of a wearer, while the securement strap 602 is configured to retain the mask panel 601 against the portion of the face of the wearer.

In this illustrative embodiment, the securement strap 602 comprises a self-adherent material 603. In this illustrative embodiment, the self-adherent material 603 is elastomeric. While multiple securement straps can be used, in the illustrative embodiment of FIG. 6, the securement strap 602 is a single securement strap. In this illustrative embodiment, the securement strap 602 is at least two inches wide.

In use, the wearer places the mask panel 601 over a portion of their face. Ideally, the wearer places the mask panel 601 over their nose and mouth.

Figure 12:
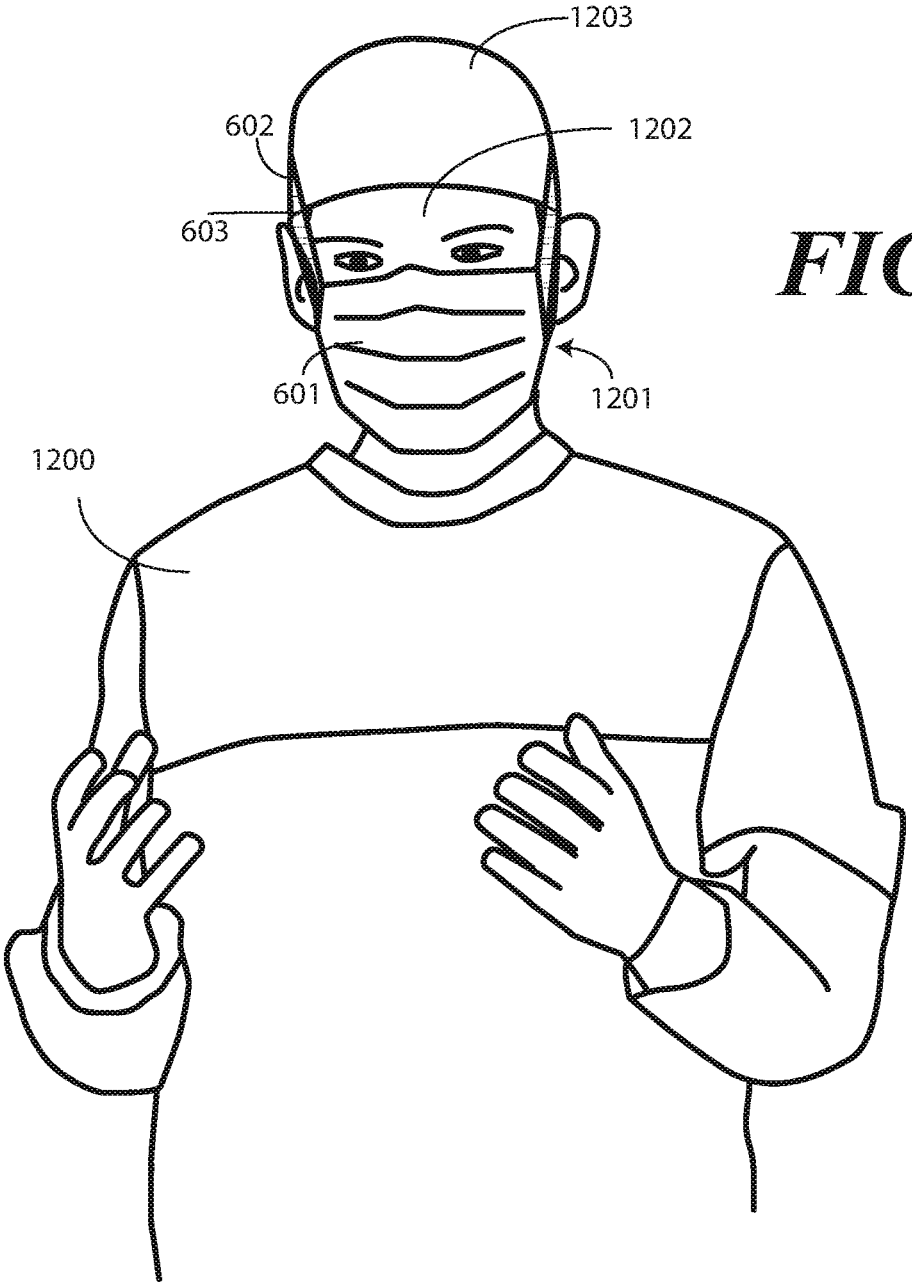
FIG. 12 illustrates a user wearing an explanatory mask in accordance with one or more embodiments of the disclosure.

Next, the wearer places the securement strap 602 about their head. Preferably, the wearer places the securement strap 602 above their ears so that it spans the parietal bone of the skull to retain the mask panel 601 against their face. Where the securement strap 602 comprises an elastomeric material, this step of donning the mask 600 can include stretching the self-adherent material 603 during the placement of the securement strap 602 about the back of the head. Turning briefly to FIG. 12, a user 1200 is shown with the mask panel 601 placed against a portion 1201 of their face 1202. The securement strap 602 passes about the back of the head 1203 to retain the mask panel 601 securely against the face 1202 of the user 1200.

Embodiments of the disclosure contemplate that a "one size fits all" mask is advantageous in retail environments. They require less inventory, take less shelf space, and make the selection process easier for a user. At the same time, embodiments of the disclosure contemplate that it can be challenging to create a securement strap 602 that fits everyone perfectly. Advantageously, by using a self-adherent material 603 as the securement strap 602, masks configured in accordance with embodiments of the disclosure are quickly and easily adjustable.

Figure 7:
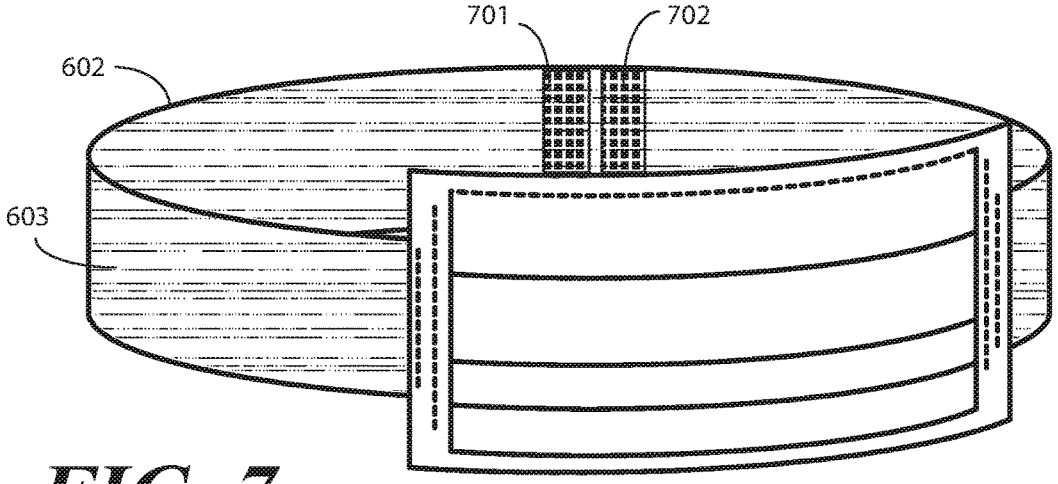
Figure 8:
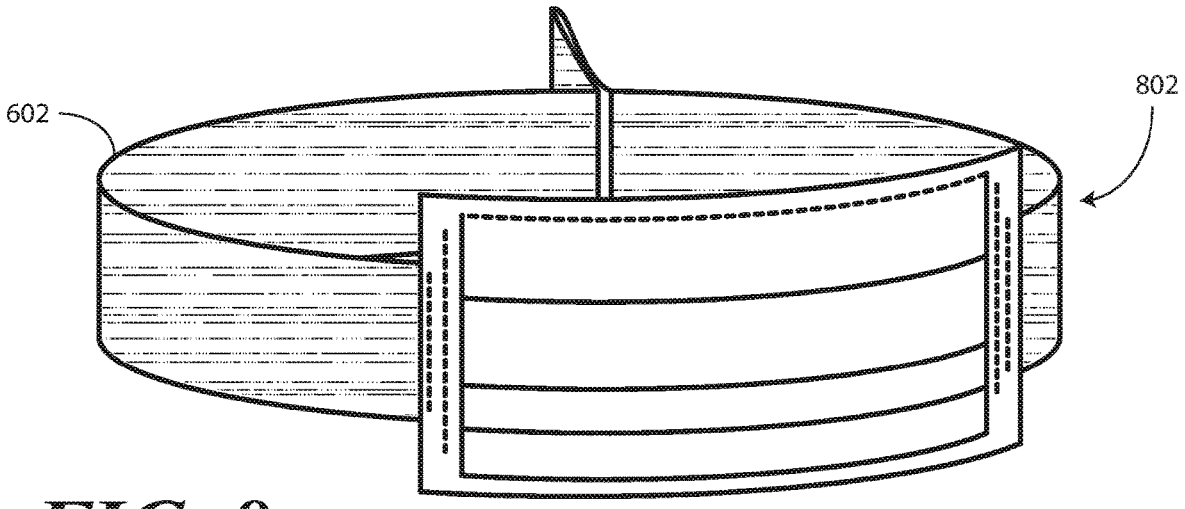

Turning now to FIG. 7, a first portion 701 and a second portion 702 of the securement strap 602 have been highlighted. To adjust the length of the securement strap 602, in one embodiment a wearer grasps the first portion 701 and the second portion 702 of the securement strap 602 between their fingers and presses them together. Since the securement strap 602 is manufactured from a self-adherent material 603, the first portion 701 sticks to the second portion 702, thereby shortening the length of the securement strap 602. Said differently, in one or more embodiments, a user adjusts a length of the securement strap 602 by compressing the first portion 701 of the self-adherent material 603 against the second portion 702 of the self-adherent material 603, thereby causing the first portion 701 to couple, physically, electrostatically, or otherwise, to the second portion 702. The adjusted securement strap 802 is shown in FIG. 8.

Once the securement strap 602 has been adjusted once, it can be further adjusted if necessary. In one or more embodiments for example, a wearer can additionally adjust the length of the securement strap 602 by compressing a third portion of the self-adherent material against a fourth portion of the self-adherent material, thereby causing the third portion of the self-adherent material to couple to the fourth portion of the self-adherent material.

Figure 9:
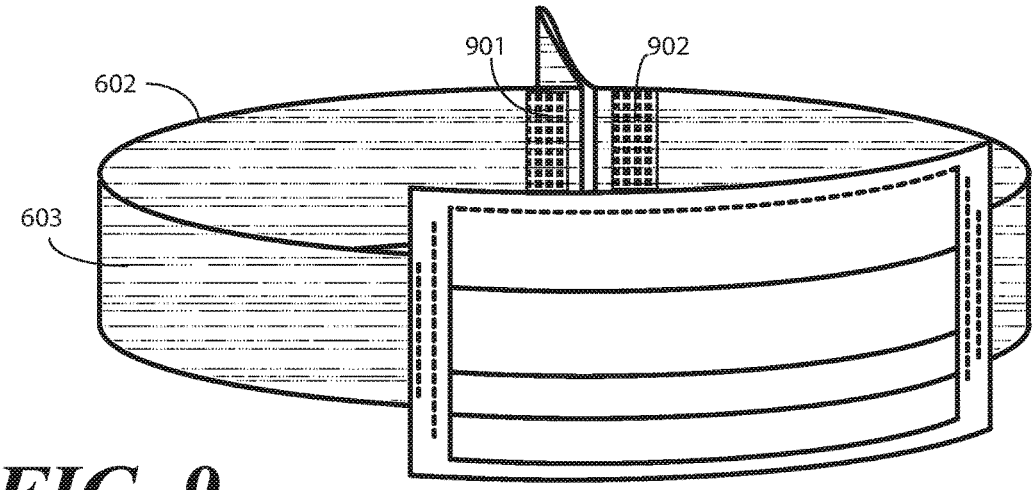
Figure 10:
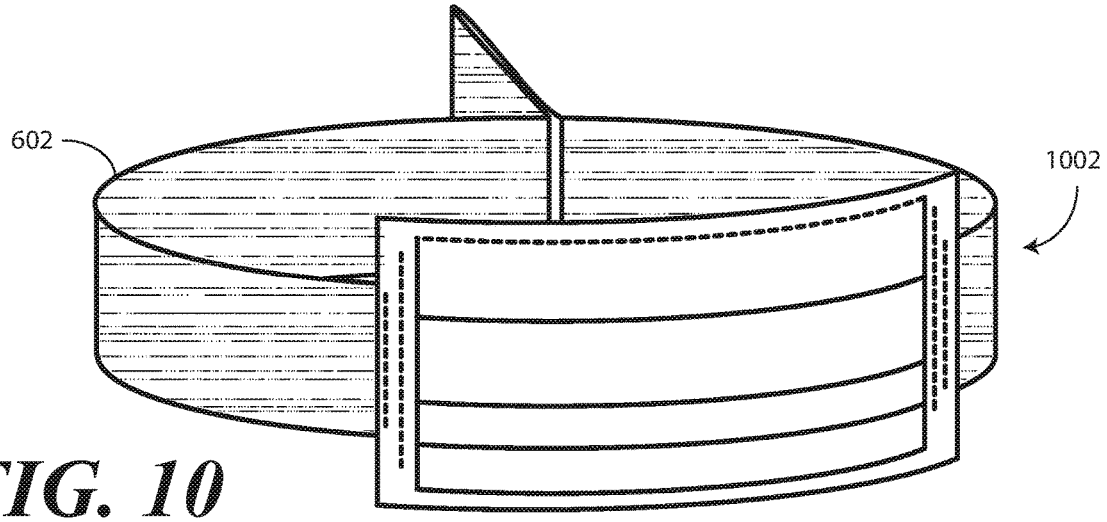

Turning to FIG. 9, a third portion 901 and a fourth portion 902 of the securement strap 602 have been highlighted. To further adjust the length of the securement strap 602, in one embodiment a wearer grasps the third portion 901 and the fourth portion 902 of the securement strap 601 between their fingers and presses them together. Since the securement strap 602 is manufactured from a self-adherent material 603, the third portion 901 sticks to the fourth portion 902, thereby shortening the length of the securement strap 602. The further adjusted securement strap 1002 is shown in FIG. 10.

Figure 11:
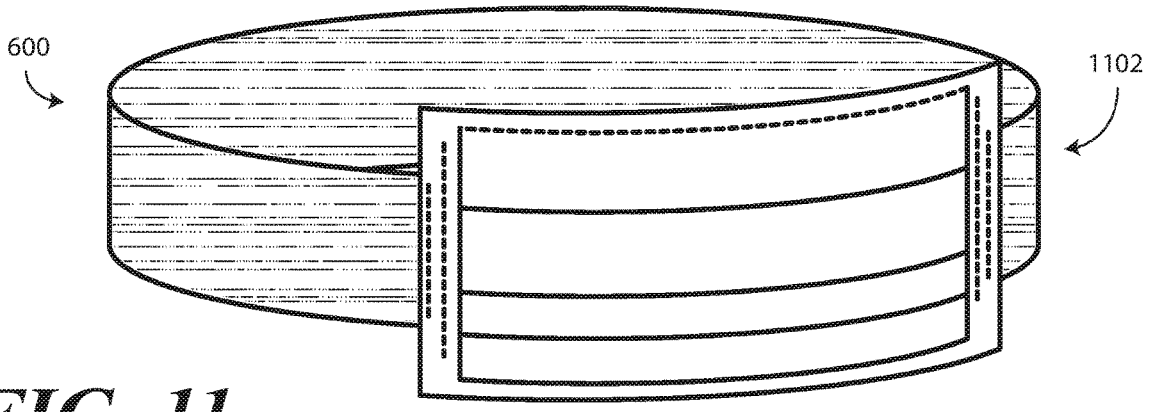

To increase the length of the securement strap 602, the steps opposite of those described above with reference to FIGS. 7-9 are performed. More specifically, the wearer pulls the first portion (701) of the self-adherent material 603 away from the second portion (702) of the self-adherent material 603 to separate the first portion (701) of the self-adherent material 603 from the second portion (702) of the self-adherent material 603 to extend a length of the securement strap 602. Similarly, the wearer can pull either the third portion (901) of the self-adherent material 603 away from the fourth portion (902) of the self-adherent material 603 to separate the third portion (901) of the self-adherent material 603 from the fourth portion (902) of the self-adherent material 603 to extend a length of the securement strap 602. The resulting elongated securement strap 1102 is shown in FIG. 11. The mask 600 can then be removed from the head of the wearer.

Figure 14:
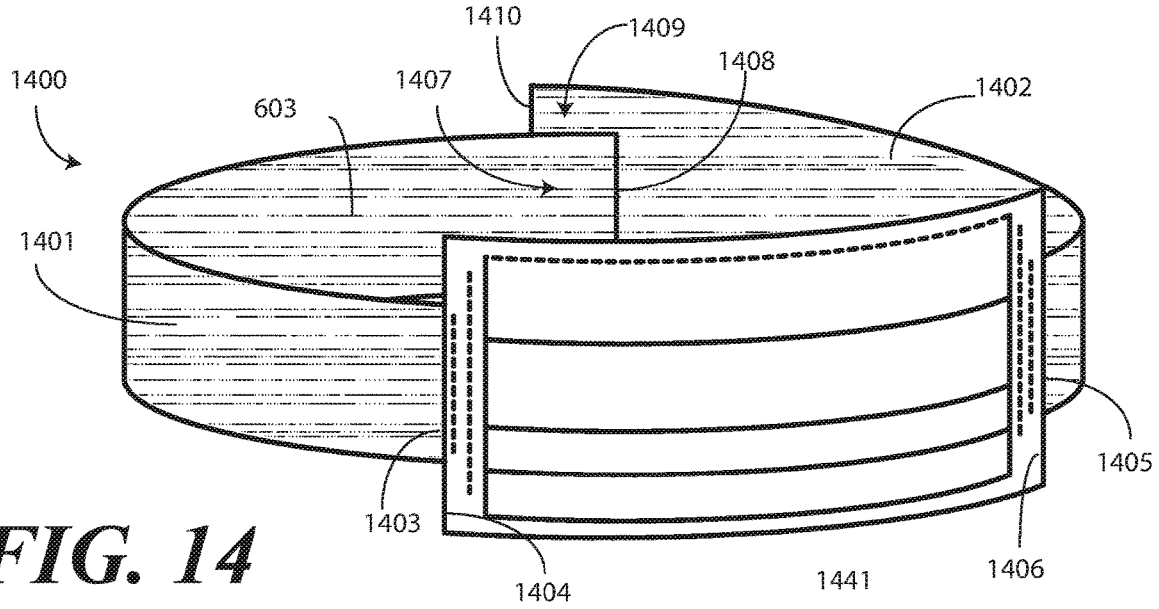
FIG. 14 illustrates yet another explanatory mask in accordance with one or more embodiments of the disclosure.

Turning now to FIG. 14, illustrated therein is an alternate mask 1400 configured in accordance with one or more embodiments of the disclosure. In this embodiment, rather than having a continuous securement strap, the mask 1400 includes a first securement strap 1401 and a second securement strap 1402. A first end 1403 of the first securement strap 1401 is coupled to a first side 1404 of the mask panel 1441. A first end 1405 of the second securement strap 1402 is coupled to a second side 1406 of the mask panel 1401.

As before, the mask panel 1441 is configured to cover a portion of a face of a wearer. The first securement strap 1401 extends around a first side of the wearer's head, while the second securement strap 1402 extends around the second side of the wearer's head. In this illustrative embodiment, the first securement strap 1401 and the second securement strap 1402 are configured to retain the mask panel 1441 against the portion of the face of the wearer.

In one embodiment, each of the first securement strap 1401 and the second securement strap 1402 comprises a self-adherent material 603. In this illustrative embodiment, the self-adherent material 603 is elastomeric. Accordingly, a portion 1407 of the first securement strap 1401 disposed near a second end 1408 of the first securement strap 1401 can be pressed against a second portion 1409 of the second securement strap 1402 disposed near a second end 1410 of the second securement strap 1402 to couple the first securement strap 1401 to the second securement strap 1402.

In use, the wearer places the mask panel 1441 over a portion of their face. Ideally, the wearer places the mask panel 1441 over their nose and mouth.

Next, the wearer places the first securement strap 1401 around a first side of the wearer's head, and the second securement strap 1402 around the second side of the wearer's head. The wearer then presses a portion 1407 of the first securement strap 1401 disposed near a second end 1408 of the first securement strap 1401 against a second portion 1409 of the second securement strap 1402 disposed near a second end 1410 of the second securement strap 1402 to couple the first securement strap 1401 to the second securement strap 1402.

Figure 15:
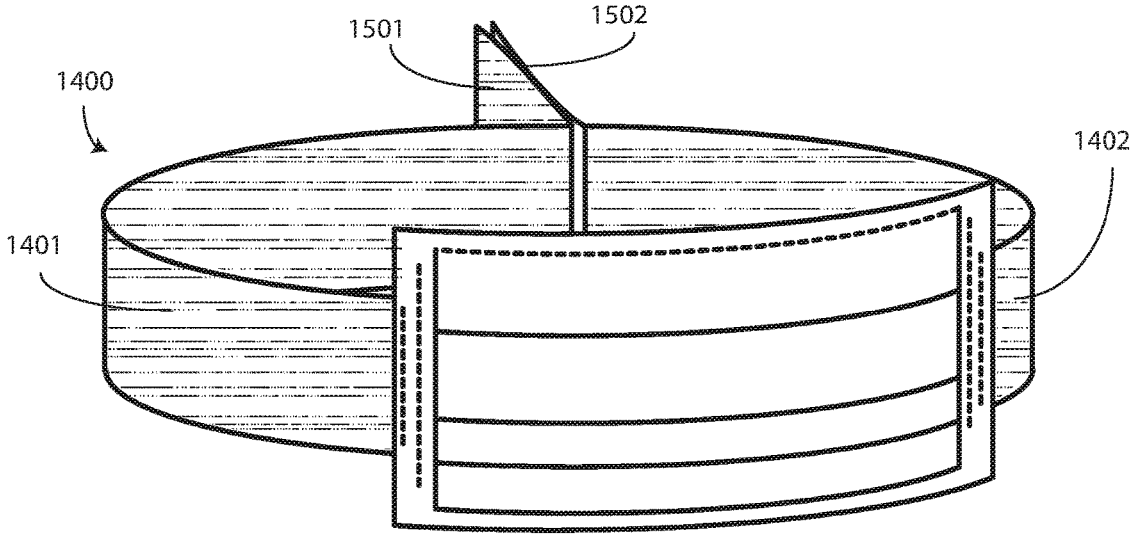
FIG. 15 illustrates one or more explanatory steps for adjusting a length of a securement strap in accordance with one or more embodiments of the disclosure.

The length defined by the first securement strap 1401 and the second securement strap 1402 can be adjusted as previously described. Turning now to FIG. 15, a first portion 1501 and a second portion 1502 of the first securement strap 1401 and the second securement strap 1402 can be pressed together. To adjust the overall length, the size of the first portion 1501 and the second portion 1502 can simply be changed. Large first portions 1501 and second portions 1502 result in a shorter overall length, while shorter first portions 1501 and second portions 1502 result in a longer overall length, and so forth. While the first portion 1501 and the second portion 1502 abut to extend distally from the circumference defined by the first securement strap 1401 and second securement strap 1402 in the illustration, they can also overlap such that the first portion 1501 and second portion 1502 lie flat against as well. To remove the mask 1400, one simply pulls the first securement strap 1401 away from the second securement strap 1402.

Figure 16:
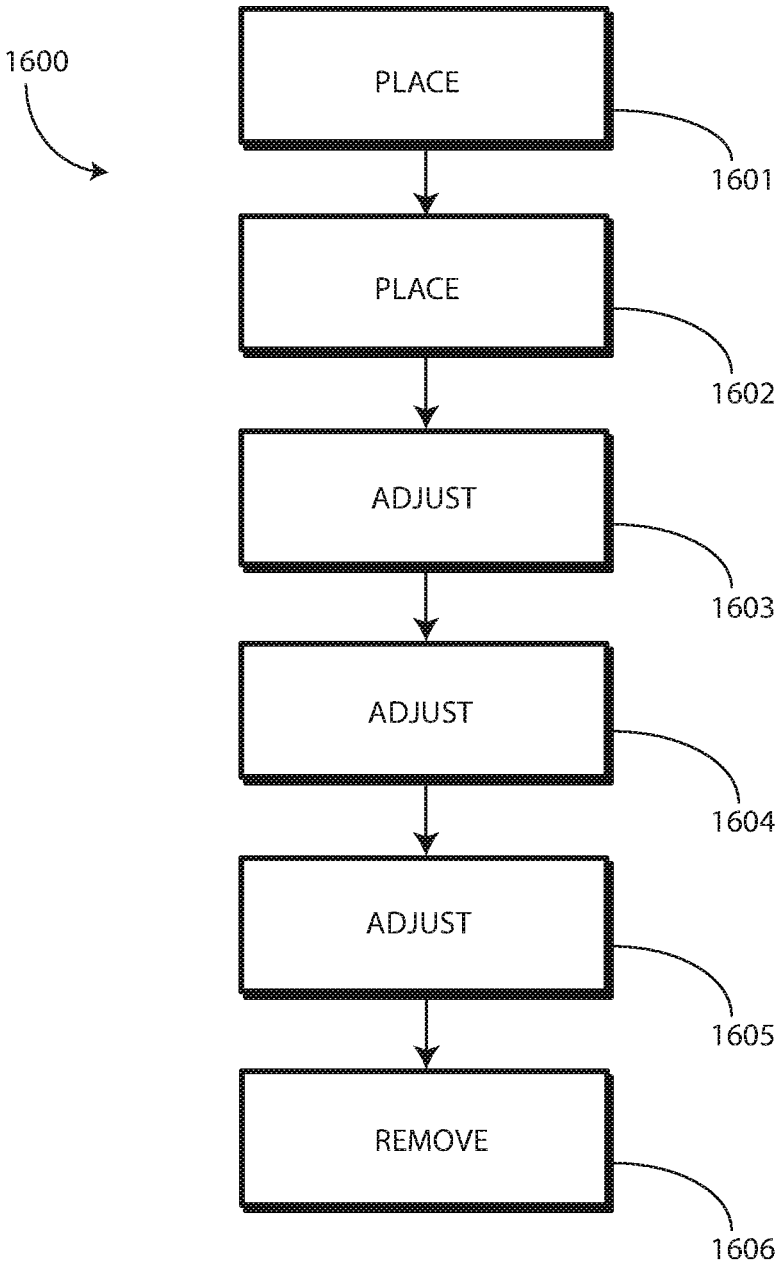
FIG. 16 illustrates one explanatory method in accordance with one or more embodiments of the disclosure.

Turning now to FIG. 16, illustrated therein is a flow chart illustrating steps of one explanatory method 1600 for donning, adjusting, and removing a mask configured in accordance with one or more embodiments of the disclosure. Many of the steps have been described above with reference to FIGS. 6-12.

Beginning at step 1601, in one embodiment the method 1600 comprises placing a mask panel over a portion of a face of a wearer. At step 1602, the method 1600 includes placing a securement strap comprising a self-adherent material about a head of a wearer. In one or more embodiments, step 1602 optionally comprises stretching the self-adherent material during placement of the securement strap. The securement strap of step 1602 can be a single securement strap in one or more embodiments. In other embodiments, the securement strap of step 1602 can comprise two, three, or four securement straps.

At step 1603, the method 1600 includes adjusting a length of the securement strap. In one embodiment, step 1603 comprises compressing a first portion of the self-adherent material against a second portion of the self-adherent material, thereby causing the first portion to couple to the second portion.

At optional step 1604, the method 1600 includes additionally adjusting the length of the securement strap. In one or more embodiments, this step 1604 includes compressing a third portion of the self-adherent material against a fourth portion of the self-adherent material, thereby causing the third portion of the self-adherent material to couple to the fourth portion of the self-adherent material.

At optional step 1605, the method 1600 includes lengthening the securement strap by pulling one of the first portion of the self-adherent material away from the second portion of the self-adherent material, and/or the third portion of the self-adherent material away from the fourth portion of the self-adherent material, to separate the first portion of the self-adherent material from the second portion of the self-adherent material and/or the third portion of the self-adherent material from the fourth portion of the self-adherent material.

At step 1606, the mask can be removed from the head of the wearer. In one or more embodiments, the mask is disposable. Where this is the case, step 1606 can also include discarding the mask.

Figure 17:
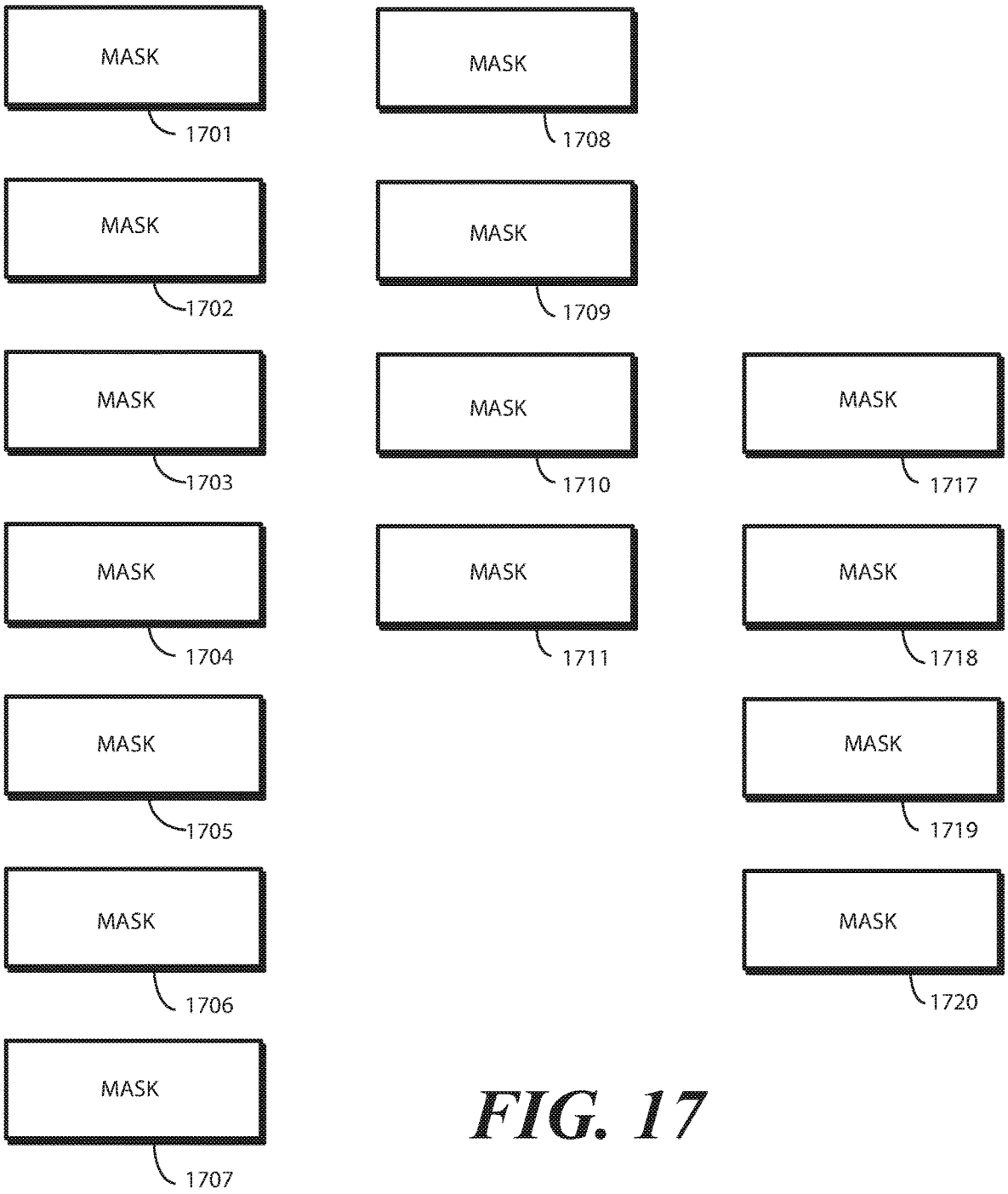
FIG. 17 illustrates one or more embodiments of the disclosure.

Turning now to FIG. 17, illustrated therein are various embodiments of the disclosure. At 1701, a mask comprises a mask panel and a securement strap. At 1701, a first end of the securement strap is coupled to a first side of the mask panel. At 1701, a second end of the securement strap is coupled to a second side of the mask panel. At 1701, the securement strap is manufactured from a self-adherent material.

At 1702, the self-adherent material of 1701 comprises an electrostatically self-adherent material. At 1703, the self-adherent material of 1701 comprises a physically self-adherent material. At 1704, the self-adherent material of 1703 comprises a porous substrate. At 1705, the porous substrate of 1704 is elastomeric.

At 1706, the self-adherent material of 1703 comprises a hook and loop fastener. At 1707, the self-adherent material of 1703 comprises a substrate with an adhesive disposed thereon.

At 1708, a length of the securement strap of 1703 is adjustable by compressing portions of the securement strap together to cause the self-adherent material to adhere to itself. At 1709, the securement strap of 1708 comprises a single securement strap. At 1710, the securement strap of 1709 is at least two inches wide. At 1711, the mask panel of 1710 defines one or more expandable folds.

At 1717, a mask comprises a mask panel configured to cover a portion of a face. At 1717, the mask comprises a securement strap configured to retain the mask panel against the portion of the face. At 1717, the securement strap comprises a self-adherent material.

At 1718, the self-adherent material of 1717 is elastomeric. At 1719, the securement strap of 1718 comprises a single securement strap. At 1720, the self-adherent material of 1719 comprises Coban.sup.™ material.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A mask, comprising:

a mask panel and a securement strap;

wherein:

the securement strap is continuous;

a first end of the securement strap is coupled to a first side of the mask panel;

a second end of the securement strap is coupled to a second side of the mask panel;

the securement strap is manufactured from a self-adherent material, wherein the self-adherent material comprises a physically self-adherent material, wherein the self-adherent material comprises a hook and loop fastener, wherein the hook and loop fastener comprises hook fasteners spanning substantially all of a first half of the securement strap and loop fasteners spanning substantially all of a second half of the securement strap; and a length of the securement strap is adjustable by compressing portions of the securement strap together to cause the self-adherent material to adhere to itself.

2. The mask of claim 1, wherein the securement strap is colored with a predefined color.

3. The mask of claim 1, wherein the securement strap is elastomeric and is capable of stretching.

4. The mask of claim 3, wherein the securement strap comprise a porous substrate.

5. The mask of claim 4, wherein printing is applied to the porous substrate.

6. The mask of claim 1, wherein printing is applied to the securement strap.

7. The mask of claim 6, wherein the securement strap is colored with a predefined color.

8. The mask of claim 6, wherein the printing explains how to adjust the mask.

9. The mask of claim 1, further comprising another securement strap coupled to the mask panel.

10. The mask of claim 9, wherein the securement strap is at least two inches wide.

11. The mask of claim 10, wherein the mask panel defines one or more expandable folds.

12. A mask, comprising:

a mask panel, a first securement strap, and a second securement strap;

wherein:

the first securement strap and the second securement strap are continuous;

a first end of the first securement strap and the second securement strap is coupled to a first side of the mask panel;

a second end of the first securement strap and the second securement strap is coupled to a second side of the mask panel;

the first securement strap and the second securement strap each comprise a self-adherent material, wherein the self-adherent material comprises a physically self-adherent material, wherein the self-adherent material comprises a hook and loop fastener, wherein the hook and loop fastener comprises hook fasteners spanning substantially all of a first half of the first securement strap and the second securement strap and loop fasteners spanning substantially all of a second half of the first securement strap and the second securement strap; and a length of each of the first securement strap and the second securement strap is adjustable by compressing portions of the each of the first securement strap and the second securement strap together, respectively, to cause the self-adherent material to adhere to itself.

13. The mask of claim 12, wherein at least one the first securement strap or the second securement strap is colored with a predefined color.

14. The mask of claim 12, wherein at least one of the first securement strap or the second securement strap is elastomeric and is capable of stretching.

15. The mask of claim 12, wherein at least one of the first securement strap or the second securement strap comprises a porous substrate.

16. The mask of claim 15, wherein printing is applied to the porous substrate.

17. The mask of claim 12, wherein printing is applied to at least one of the first securement strap or the second securement strap.

18. The mask of claim 17, wherein the printing explains how to adjust the mask.

19. A mask, comprising:

a mask panel and a colored securement strap;

wherein:

the colored securement strap is continuous;

a first end of the colored securement strap is coupled to a first side of the mask panel;

a second end of the colored securement strap is coupled to a second side of the mask panel;

the colored securement strap is manufactured from a self-adherent material, wherein the self-adherent material comprises a physically self-adherent material, wherein the self-adherent material comprises a hook and loop fastener, wherein the hook and loop fastener comprises hook fasteners spanning substantially all of a first half of the colored securement strap and loop fasteners spanning substantially all of a second half of the colored securement strap; and a length of the colored securement strap is adjustable by compressing portions of the colored securement strap together to cause the self-adherent material to adhere to itself.

20. The mask of claim 19, further comprising printing applied to the colored securement strap.

* * * * *